US005463919A

United States Patent [19]

Paybarah et al.

[11] Patent Number: 5,463,919

[45] Date of Patent: Nov. 7, 1995

[54] APPARATUS FOR CUTTING WOUND COILS

[75] Inventors: Ali Paybarah; Joseph A. McWilliams, both of Droitwich, United Kingdom

[73] Assignee: Zortech International Limited, United Kingdom

[21] Appl. No.: 183,841

[22] Filed: Jan. 21, 1994

Related U.S. Application Data

[63] Continuation-in-part of Ser. No. 968,208, Oct. 29, 1992, abandoned.

[30] Foreign Application Priority Data

Nov. 2, 1991 [GB] United Kingdom ..... 9123298

[51] Int. Cl.[6] ..... B26D 07/06

[52] U.S. Cl. ..... 82/92; 82/101; 83/907; 83/444

[58] Field of Search ..... 83/907, 491, 331, 83/821, 824, 504, 665, 676, 444; 82/47, 92, 97, 101; 140/103

[56] References Cited

U.S. PATENT DOCUMENTS

| | | | |
|---|---|---|---|
| 3,370,495 | 2/1968 | Platt | 83/176 |
| 3,838,617 | 10/1974 | Felker | 83/907 |
| 3,859,882 | 1/1975 | Demuth | 83/482 |
| 3,886,655 | 6/1975 | Molnar | 30/90.3 |
| 4,090,425 | 5/1978 | Platt | 83/402 |
| 4,292,867 | 10/1981 | Stofells | 82/47 |
| 4,798,072 | 1/1989 | VanMeggelan | 72/132 |
| 5,127,290 | 7/1992 | Warner | 82/47 |

FOREIGN PATENT DOCUMENTS

| | | |
|---|---|---|
| 1243992 | 9/1960 | France . |
| 2439064 | 5/1980 | France . |
| 812451 | 3/1981 | U.S.S.R. . |

*Primary Examiner*—Rinaldi I. Rada
*Assistant Examiner*—Allan M. Schrock
*Attorney, Agent, or Firm*—Ira S. Dorman

[57] ABSTRACT

A wound coil which is rotating about its axis is cut and severed against a stationary member by moving a rotatable cutting blade incorporating a circular cutting edge towards the rotating coil and the stationary member such that the cutting blade rotates about the axis of the arcuate cutting edge against the wound coil, becomes inserted between adjacent turns of the wound coil and cuts the wire forming the coil against the support. Once the coil has been cut, the cutting blade is moved away from the coil. A roller is provided to limit movement of the cutting edge of the cutting blade in the axial direction of the coil.

2 Claims, 2 Drawing Sheets

APPARATUS FOR CUTTING WOUND COILS

This application is a continuation-in-part application based on prior application Ser. No. 7/968,208 filed Oct. 29, 1992, for IMPROVEMENTS IN OR RELATING TO CUTTING WOUND COILS now abandoned.

The present invention relates to an apparatus for cutting wound coils, and more particularly is concerned with a method and an apparatus for cutting the wire of a wound coil against a support.

BACKGROUND TO THE INVENTION

It is known to cut the wire of a wound coil against a support through which the coil passes, for example so as to cut the coil into predetermined lengths. This is accomplished by means of a cutting blade, the cutting blade being movable towards and away from the support such that, as the cutting blade moves towards the support, the blade is inserted between adjacent turns of the coil, and cuts the wire as the coil rotates. The disadvantage of this known method is that the blade does not reliably become inserted between adjacent turns of the coil, particularly when the coil is rotating at high speed, and this can lead to deformation of the ends of the coils. There is therefore a need to improve the method of cutting the wire so as to minimise any deformation of the ends of the coils, particularly when the coil is rotating at high speed.

OBJECT OF THE INVENTION

It is an object of the present invention to provide an apparatus for cutting wound coils in which the wire is cut in a manner which reduces the likelihood of the ends of the coils being deformed.

SUMMARY OF THE INVENTION

According to the present invention there is provided an apparatus for cutting wound coils comprising:

- a stationary member having an aperture therethrough, the surface defining the aperture providing a support for supporting wire in the form of a wound coil which is rotating about its axis and extends through the aperture;
- a support member movable toward and away from the stationary member;
- a cutting blade having a circular cutting edge, the cutting blade being freely rotatably mounted on the support member so as to be rotatable about the axis of the circular cutting edge and to be rotatable with the wound coil, the cutting blade operating to cut and sever the wire comprising the wound coil when moved thereagainst by the support member; and
- means for limiting movement of the cutting edge of the cutting blade in the axial direction of the coil.

The stationary member may comprise a coil retaining member for limiting movement of the coil as a result of movement of the cutting blade towards and away from the coil. A lifting pin may be movable within the coil retaining member towards and away from the coil for limiting movement of the coil relative to the coil retaining member.

The means for limiting movement of the cutting edge of the cutting blade in the axial direction of the coil may comprise a roller.

For a better understanding of the present invention and to show more clearly how it may be carried into effect reference will now be made, by way of example, to the accompanying drawings in which:

DESCRIPTION OF PREFERRED EMBODIMENT

Figure 1:
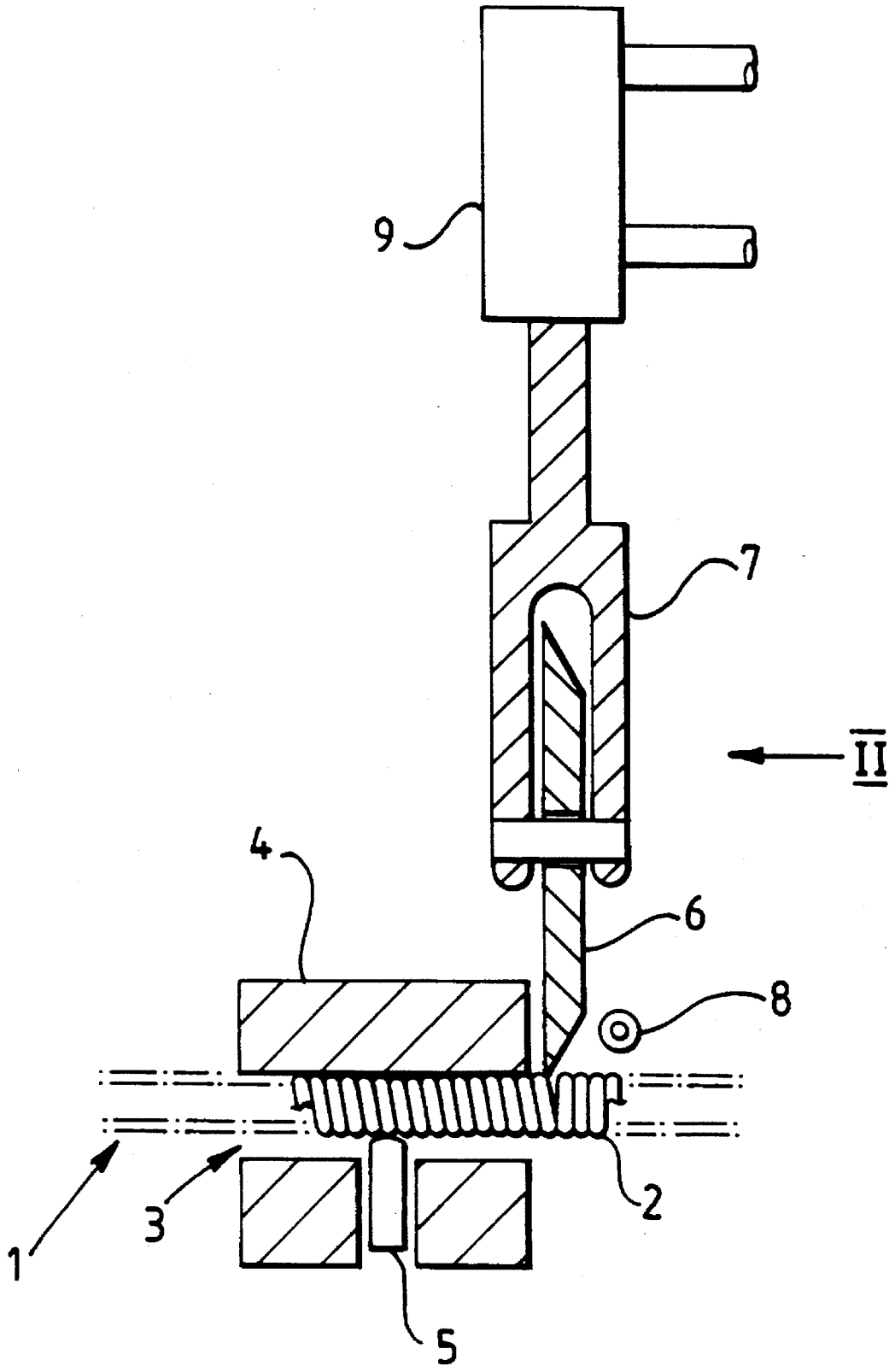
FIG. 1 is a longitudinal partial cross-sectional view of one embodiment of an apparatus according to the present invention for cutting wound coils.
Figure 2:
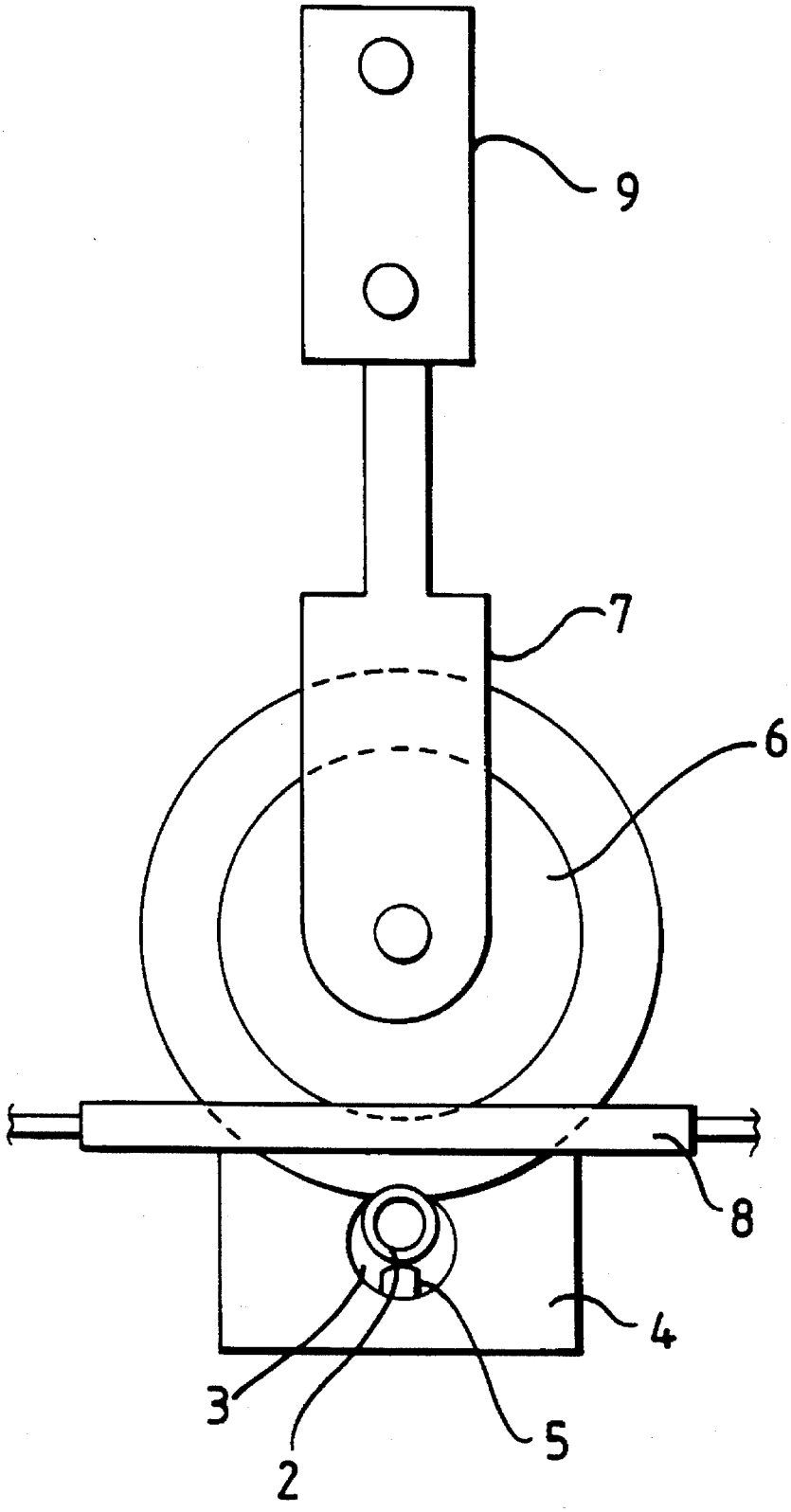
FIG. 2 is an end elevational view of the apparatus shown in FIG. 1 looking in the direction of the arrow II in FIG. 1.

FIGS. 1 and 2 show a wound coil 1 of wire 2, the coil 1 passing through an aperture 3 in a coil retaining member in the form of a coil retaining block 4. The wire 2 may be a resistance heating wire comprising, for example, an iron-chromium-aluminium alloy. Also provided within the coil retaining block 4 is a coil lifting pin 5 for intermittently raising the coil 1 against the upper surface of the aperture 3 so as to limit movement of the coil relative to the coil retaining block and to move the coil towards a cutting blade 6 which is positioned at that side of the coil retaining block 4 from which the wound coil emerges so as to facilitate indexing the turns of the coil with the cutting blade 6.

Cutting blade 6 is circular in shape with an arcuate cutting edge in the form of a circular cutting edge around the periphery thereof and is provided with a central aperture by means of which the blade 6 is rotatably mounted in a cutting blade support member 7 so as to be rotatable about the axis of the circular cutting edge. The cutting blade may have a diameter of about 60 mm. The support member 7 is movable towards and away from the coil 1 by means of a pneumatic cylinder 9, although other means such as hydraulic means or an electrical relay can be used, so as to cut and sever the wire 2 against the base of the aperture 3. Movement limiting means in the form of a roller 8 serves to restrain movement of the cutting blade 6 in the axial direction of the coil 1.

In use of the apparatus, the required length of the coils is determined, for example in dependence on the number of turns required and thus the number of revolutions of the coil 1. Each time the required length of coil has been wound and passed through the aperture in the coil retaining block 4, the coil lifting pin 5 is raised by means not shown, for example by pneumatic or hydraulic means or by an electrical relay, so as to raise the coil against the upper surface of the aperture 3 in the coil retaining block 4 and to facilitate indexing the cutting blade 6 with the turns of the coil 1. The cutting blade 6, because it is freely rotatable, rotates with the coil. This mutual rotation reduces relative movement between the cutting blade 6 and the coil 1 and facilitates the cutting blade becoming inserted between adjacent turns of the coil as the support member 7 is moved by the pneumatic cylinder 9 towards the base of the aperture 3 so as to cut the wire.

We have found that the use of a rotatable cutting blade in place of a conventional non-rotatable cutting blade considerably reduces the likelihood of the ends of the coils being deformed, results in reduced wear of the cutting blade, and also facilitates increased rotational speeds of the coil, up to 10,000 r.p.m. or more, and thus increased productivity, compared-with the usual rotational speeds of approximately 2,000 to 4,000 r.p.m.

We claim:

1. Apparatus for cutting wound coils comprising:

a stationary member having an aperture extending axially therethrough, the surface defining the aperture providing a support for supporting wire in the form of a wound coil which is rotating about its axis and extends through the aperture with the axis of the coil substantially parallel to the axis of the aperture;

a circular cutting blade;

a support member movable toward and away from the stationary member, and including means for mounting the circular cutting blade for rotation about an axis of rotation substantially parallel to the aperture axis;

the circular cutting blade having a circular cutting edge, the cutting blade and the means for mounting being so constructed as to cause the cutting blade to be mounted for free rotation of the blade, relative to the means for mounting, about the axis of rotation, whereby the blade is rotated by engagement of the circular cutting edge with the rotating wound coil, and whereby the blade can operate to cut and sever the wire comprising the wound coil when moved thereagainst by the support member; and roller means for limiting movement of cutting edge of the cutting blade in the axial direction of coil.

2. Apparatus as claimed in claim 1, wherein a lifting pin is movable within the stationary member towards and away from the coil for limiting movement of the coil relative to the stationary member.

* * * * *